United States Patent [19]

Menestreau et al.

[11] Patent Number: 4,899,166

[45] Date of Patent: Feb. 6, 1990

[54] SELF PROTECTED AND TRANSPORTABLE FLAT LATTICE ANTENNA

[75] Inventors: Alain Menestreau, Saintry S/Seine; Maurice Marchand, Sevran; Alain Cornu, Cachan; Richard Le Brun, Malakoff, all of France

[73] Assignee: IMT Radio Professionnelle, Boulogne Billancourt, France

[21] Appl. No.: 177,977

[22] Filed: Apr. 5, 1988

[30] Foreign Application Priority Data

Apr. 10, 1987 [FR] France ..... 87 05106

[51] Int. Cl.[4] ..... H01Q 1/42

[52] U.S. Cl. ..... 343/873

[58] Field of Search ..... 343/872, 873, 912

[56] References Cited

U.S. PATENT DOCUMENTS 4,426,649 1/1984 Dubost et al. ..... 343/700 MS
4,635,071 1/1987 Gounder et al. ..... 343/912
4,677,443 6/1987 Koetje et al. ..... 343/872
4,686,150 8/1987 Talley et al. ..... 343/912

FOREIGN PATENT DOCUMENTS 13908 8/1983 France .
2487588 11/1984 France .

*Primary Examiner*—Joseph E. Clawson, Jr.
*Assistant Examiner*—Doris J. Johnson
*Attorney, Agent, or Firm*—Cushman, Darby & Cushman

[57] ABSTRACT

A flat, self protected and transportable lattice is provided using a radiating structure formed of a three-plate line, with sources forming a lattice etched on one of the conducting planes. This structure further comprises two identical foam sheets bonded by an adhesive which allows sliding in the two conducting planes of the radiating structure, each foam sheet being covered with a thin rigid bonded plate. The plates thus bonded are chosen transparent to the radiation and form a symmetrical structure whose inherent flatness and rigidity are ensured, which is self protected and which is also sealed by means of a banding system.

9 Claims, 3 Drawing Sheets

Section A-A

Section D-D

Section C

Section B-B

SELF PROTECTED AND TRANSPORTABLE FLAT LATTICE ANTENNA

BACKGROUND OF THE INVENTION

1. Field of the Invention

The invention relates to the radar field and more particular to a flat antenna adapted more particularly to ground surveillance radar.

2. Description of the Prior Art

From French patent N°80 16620 in particular, a flat lattice antenna structure is known, having a three-plate line and formed of a source lattice. The antenna includes an energy distribution line placed between two insulating plates, each of these insulating plates being covered with a conducting layer. On the active face of the antenna, the sources are etched, in the copper, the other face of the antenna having a continuous copper layer. The two insulating plates are bonded and the assembly forms the radiating structure.

The use of this type of antenna, more particularly for a ground surveillance radar which might be transportable, requires a certain number of problems to be solved. In fact, the material forming the insulator is a material of the non woven glass-teflon type, of the type for example sold under the trademark DUROID 5880 by the firm RODGERS, chosen for minimizing the losses particularly at high frequency, namely in band X between 9 and 10 GHz. This material is a very good electrical insulator, but it has medicore mechanical characteristics.

In particular, this material has very different expansion coefficients in the three directions. For a flat antenna having dimensions of 900 mm×450 mm, the corresponding extension may reach 3 mm. Now, the radiating free of the antenna must be perfectly flat, the tolerance being less than 1 mm. In addition to these problems of expansion, the rigidity of the antenna must of course be ensured even apart from temperature variations.

For a good mechanical strength, an immediate solution consists in placing this antenna on a support, for example a steel support, or a mechanical structure of the mechanical "honeycomb" material type. Calculations show that in order to absorb the above mentioned effects, the support should be very rigid. Furthermore, the radiating face of the antenna must also be protected by a radome which is transparent to the radiation. This radome further adds to the weight of the structure and makes the assembly very difficult to transport.

SUMMARY OF THE INVENTION

The invention provides then a flat lattice antenna which is self protected and maintained perfectly flat while remaining readily transportable.

According to the invention, a flat self protected and transportable lattice antenna, including a radiating structure with three-plate line, includes a foam sheet bonded on each face of the radiating structure by an adhesive which allows the radiating structure to slide with respect to the foam, and a thin rigid plate is bonded to each foam sheet.

In a preferred embodiment, the means for connecting the antenna to the system are specially adapted to the above mentioned structure so as to maintain the characteristics of rigidity and mechanical strength as far as the connection elements.

In accordance with the invention, the above described antenna further includes a connection box including a coaxial cord connected electrically to the three-plate line by a connector and having at its other end a coaxial socket for electrical connection to the outside, the thin rigid plates being also bonded to bearing faces provided on the connection box.

BRIEF DESCRIPTION OF THE DRAWINGS

The invention will be better understood and other characteristics will be clear from the following description with reference to the accompanying FIGS., in which.

The same elements bear throughout these Figures the same references.

DESCRIPTION OF THE PREFERRED EMBODIMENT

Instead of providing the rigidity and inherent flatness of the above described large sized flat antenna using heavy mechanical elements which prevent any movement of the useful surface of the antenna, the invention leaves the antenna free but provides a structure which is symmetrical about the median plane of the 3 plate line, each element provided at the rear being placed symmetrically on the front face; the elements chosen provide the required electric transparency and at the same time solve the problem of the randome for protecting the active face.

Figure 1:
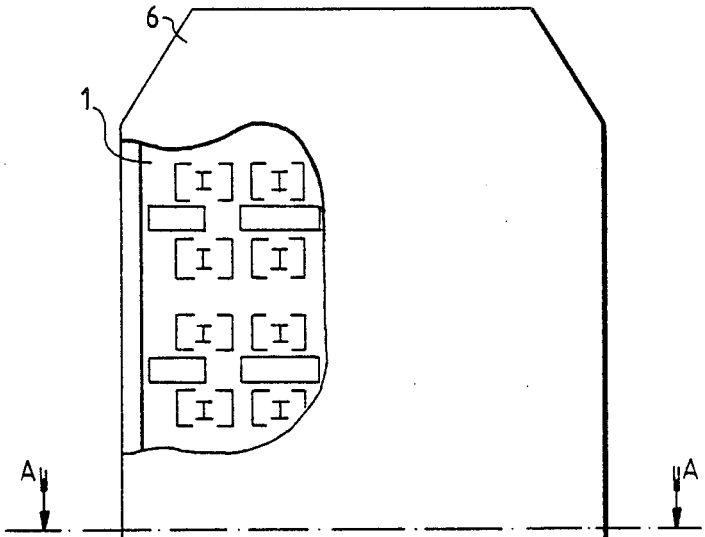
FIGS. 1 and 2 show the antenna of the invention respectively in a top view and in a cross sectional view.
Figure 2:
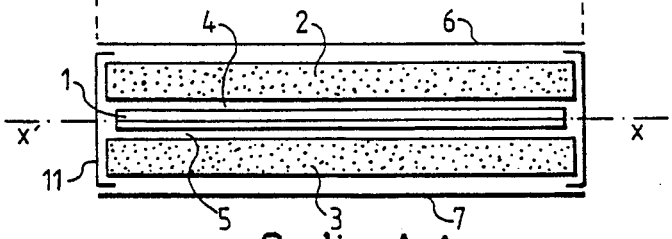

FIG. 1 shows schematically in a top view from the radiating face side, the lattice antenna which has been shown with an open zone for showing the radiating element lattice. The corresponding FIG. 2, shows a cross section of the antenna, through axis AA of FIG. 1. The following description refers to these two Figures. The axis XX' in FIG. 2 shows the median plane of the three-plate line. As mentioned above and described in detail in French patent n° 80 16620, the three-plate line 1 comprises a conducting strip sandwiched between two insulating plates each coated with a conducting layer or ground plane, generally a copper layer 35μ thick. On the active face of the antenna, the sources are etched in the copper as shown in the cut away portion of FIG. 1, the other face keeping a continuous copper layer so as to form a flat two dimensional doublet lattice.

In order to use this known radiating structure, the invention associates therewith other elements added to its two flat faces, symmetrically with respect to the median plane of line xx':

two rigid foam panels 2 and 3 are bonded by a transfer adhesive 4 and 5 to the two faces of the three-plate line. These panels may be formed of ROHACELL type foam, each foam panel is then covered with a thin rigid bonded plate or external skin, made from epoxy glass, respectively 6 and 7.

Each bonded element increase the overall moment of inertia, and the forces are always in opposition on each side of the median plane. The rigidity is provided by the moment of inertia and the inherent flatness by the straightness of the added elements. The stresses due to temperature expansion are neutralized by balancing the antagonistic forces created on each side of the median plane. The inherent flatness of the assembly is therefore insured. The foam is practically inert, that is to say that there are no problems of expansion, but the connections between the foam sheets and the planes of the three-plate antenna are very important: the bonding material used, namely the transfer adhesive 4 and 5, must allow sliding created by the difference of thermal expansion between the materials.

Figure 3:
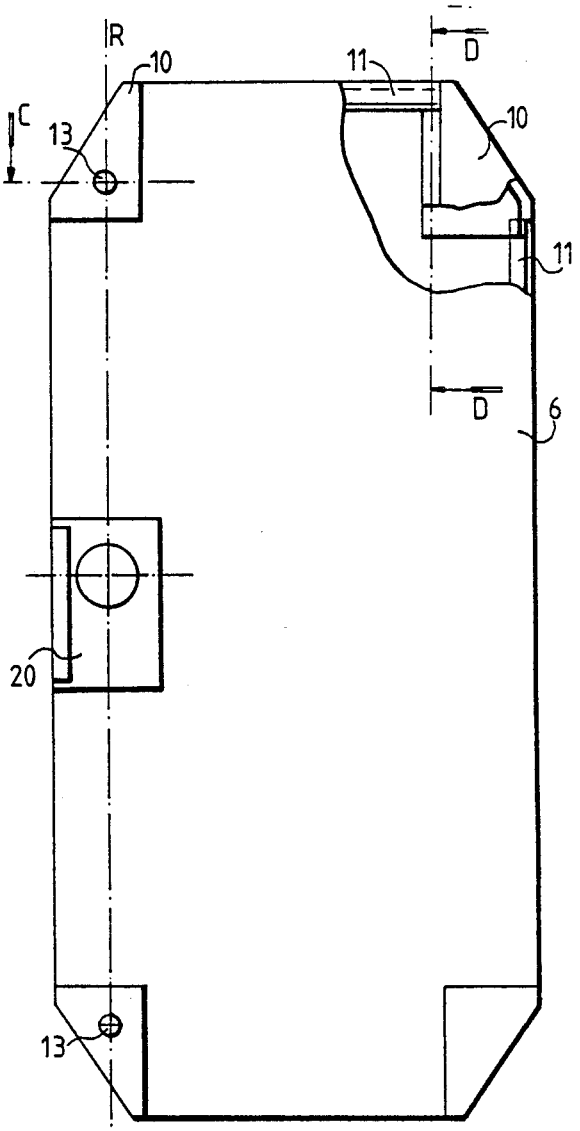
FIGS. 3, 4 and 5 show the antenna and details of the corner pieces, respectively in a top view and in two sectional views.
Figure 5:
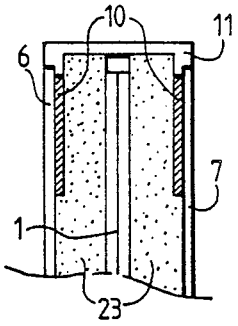
Figure 4:
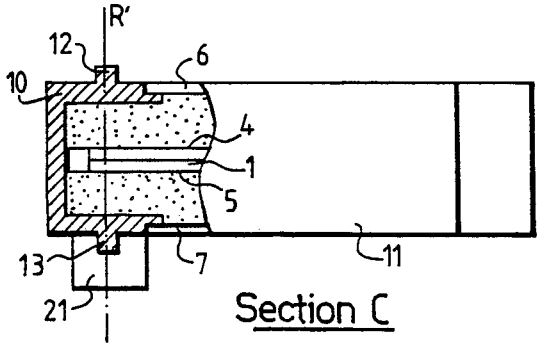

Simultaneously, protection of the three-plate antenna is provided by the assembly of bonded elements further used, as described above, for the geometrical strength. The nature and thickness of the materials thus deposited are determined by the frequency of the antenna; they provide the electric transparency required for correct operation of the antenna. This protection plays the role of the usual radome, protects against shocks and provides sealing. For that, it is completed by a special bonding system which includes both corner pieces and shaped sections shown in greater detail in FIGS. 3, 4 and 5. FIG. 3 is a bottom view in which a cut out formed in a corner shows the arrangement of the different parts with respect to each other. FIG. 4 is a section through axis C of FIG. 3 and FIG. 5 is a section through axis D of FIG. 3.

The corner pieces 10 confine the above described structure, including the three-plate antenna and the bonded foam sheets, in the four cut corners. These corner pieces are provided with bearing surfaces which receive shaped sections 11 which confine the four sides of the foam sheet and three-plate antenna structure. Studs 12 ,13 are provided on two of the corner pieces for centering a polarizer as described above. The above described rigid epoxy glass plates 6 and 7 are then bonded to the foam sheets 2 and 3, on the shaped sections which confine them, as well as on the connection box 20 described with greater detail hereafter.

Figure 8:
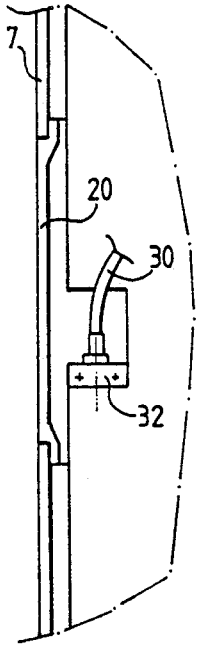
FIGS. 6, 7 and 8 show more particularly the antenna at the level of the connection means, respectively seen in a top view and in two sectional views.
Figure 6:
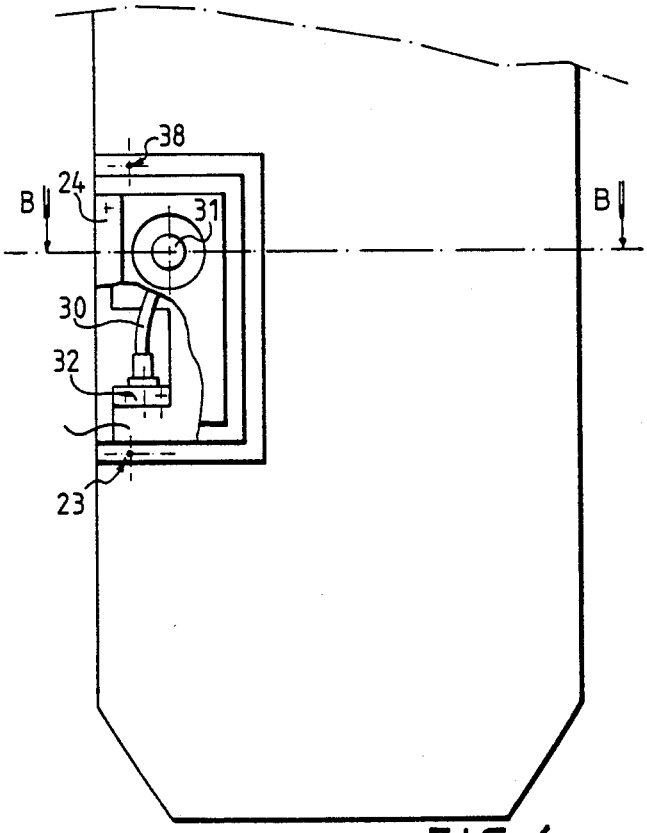
Figure 7:
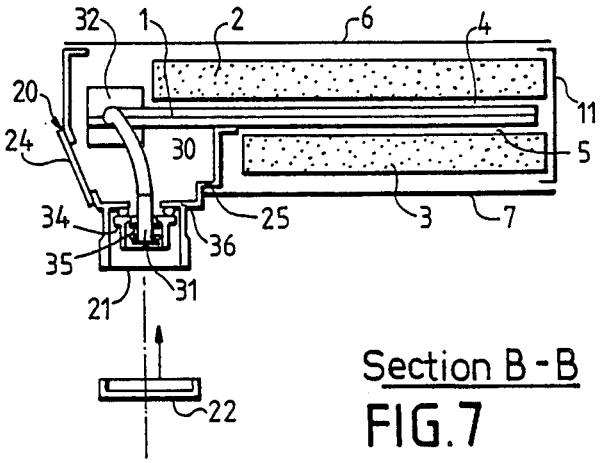

FIGS. 6, 7 and 8 show the details of the connection system. FIG. 6 is a bottom view, FIG. 7 is a cross sectional view through the axis B of FIG. 6, and FIG. 8 is a section through the median plane. The same elements as in the preceding Figures have been shown by the same references. The connection between the three-plate line and outside is provided by a flexible low loss coaxial cable 30. At one end, a pluggable type coaxial socket 31 is provided for connecting an external coaxial cable; at the other end the coaxial cable is connected to the three-plate line by a connector 32 of the type described in the French patent application n° 83 13908 in the name of the applicant, which provides a removable junction between the three-plate line and the coaxial cable. The coaxial cable 30 therefore connects the line output connector 32 to the connection box 20 which includes the pluggable coaxial socket 31 floating in its base 34 and mounted on a spring 35. When inserted on the appropriate base, the body of the coaxial socket is centered in the body of the base, spring 35 maintaining a force which eliminates contact deficiencies due to vibrations. In addition, an O seal provides sealing between the body of the fixed base 34 and the body of the appropriate socket. The body continues the electric continuity of the screening of the antenna through the coaxial cable. The core is protected electrically and physically by the bodies of the socket and this base fitted together.

The connection box 20 provides sealing by application of the epoxy glass plates 6 and 7 and of the shaped sections 11 on bearing surfaces 25 which serve for sealing the assembly.

The connection box also ensures the electric continuity of the ground plane of the three-plate antenna by fixing conducting seals 36 to the conducting adhesive between base 34 of the pluggable coaxial socket and the connection box, and by sealing the box 20 to the conducting adhesive on the ground plane of the three-plate line.

The connection box also protects the pluggable coaxial socket by a skirt 21 which receives a sealing plug 22 during transport or after dismantling.

Skirt 21 of the connection box receives the mechanical stresses during use, and these stresses are taken up by means of shear pins 23 housed between the connection box and the three-plate antenna.

Finally, this box and the associated structure ensure the maintainability of the coaxial connection. The connection box has a sealed cover 24 which closes a window formed in the connection box. This window gives access to the inside of the box for checking and repairing any part of the coaxial junction.

Finally, a polarizer is fitted to the active face of the antenna. This polarizer is positioned and referenced with respect to the axis yy' of the assembly of FIG. 3, such positioning being effected by means of studs 12 provided on two of the corner pieces of the structure and forming an integral part of these corner pieces. The three-plate antenna itself is set in accordance with the same axis yy' passing through two studs 13 also situated on the same angle pieces and symmetrical with studs 12 but on the rear face. The axis of skirt 21 of the connection box also intersects the axis yy'.

The structure of the flat lattice antenna thus obtained is self protected, in particular sealed, and provides great safety of electrical operation considering the different measures taken for providing electric continuity and in addition has the advantage of being light, readily transportable, and maintained under all conditions with an inherent flatness such that the maximum blocking of the three-plate antenna never exceeds the tolerance of 1 mm, even with large panel dimensions, 950×450 mm for example. This flat lattice antenna applies in particular to band X (9 to 10 GHz) radars but may also cover other frequency bands.

The above structure is not limitative and in particular the materials mentioned may be replaced by any other material fulfilling equivalent functions. The conditions which it is indispsensable to provide are that the connection between the inert material and the three plate antenna is provided by means of an adhesive which allows sliding, the bonded connection between the inert material (foam) and the rigid external skin, epoxy resin, being provided in any way on condition that the connection is rigid. The assembly obtained weighs less than 5 kg and the antenna output adapted to this structure provides mechanical and electrical protection and sealing of the antenna with respect to the outside. This connection box which also serves for the radioelecltric connection of the antenna absorbs the mechanical forces without transmitting them. The essential property of the connection box is that it is very firmly secured to the assembly, the different layers forming the structure of the antenna being welded thereto.

What is claimed is:

1. A flat, self protected and transportable lattice antenna comprising:

a flat three-plate line radiating structure, a foam sheet, having a different thermal expansion coefficient than said flat three-plate line radiating structure, bonded to each face of the radiating structure by an adhesive which allows the radiating structure to slide with respect to the foam, and a thin rigid plate bonded to each said foam sheet.

2. The antenna as claimed in claim 1, further comprising a banding system formed of corner pieces and shaped sections for confining the assembly formed by the radiating structure and the foam sheets, respectively in the corners and on the sides, the thin rigid plates being bonded to the foam and also bearing on the corner pieces and on the shaped sections for further sealing thereof.

3. The antenna as claimed in one of claims 1 and 2, wherein the external rigid plates are formed of epoxy glass.

4. The antenna as claimed in one of claims 1 to 3, further including a connection box with a coaxial cable electrically connected to the three-plate line by a connector and having its other end a coaxial socket for electric connection to the outside, a thin rigid plate being also bonded to bearing faces provided on the connection box.

5. The antenna as claimed in claim 4, wherein the box includes a skirt surrounding the coaxial socket and receiving a plug which maintains sealing during transport.

6. The antenna as claimed in claim 4, wherein a window with a sealing cover is provided in the connection box.

7. The antenna as claimed in claim 4, wherein the connection box provides the electric continuity between the ground plane of the three-plate line to which the box is bonded by a conducting adhesive and the base of the coaxial socket, to which this box is connected via a conducting seal bonded by a conducting adhesive.

8. The antenna as claimed in claim 4, wherein the connector connecting the three-plate line to the coaxial cable is a removable connector.

9. The antenna as claimed in claim 1, wherein two of the corner pieces are provided with studs, on the front radiating face of the antenna, which are used for placing a polarizer on this front face.

* * * * *

UNITED STATES PATENT AND TRADEMARK OFFICE

CERTIFICATE OF CORRECTION

PATENT NO. : 4,899,166

DATED : February 6, 1990

INVENTOR(S) : MENESTREAU et al.

It is certified that error appears in the above-identified patent and that said Letters Patent is hereby corrected as shown below:

Title page, item [73] should read as follows:

Assignee: LMT Radio Professionnelle

Signed and Sealed this

Sixteenth Day of April, 1991

*Attest:*

HARRY F. MANBECK, JR.

*Attesting Officer*

*Commissioner of Patents and Trademarks*